US005979337A

United States Patent [19]

Clark et al.

[11] Patent Number: 5,979,337

[45] Date of Patent: Nov. 9, 1999

[54] PORTABLE THREE-WAY DESK

[76] Inventors: Jlyn Clark; Donna Koussa, both of 2612 Quarterhorse Way, Richland, Wash. 99352

[21] Appl. No.: 09/066,095

[22] Filed: Apr. 23, 1998

[51] Int. Cl.[6] ..... A47B 23/00

[52] U.S. Cl. ..... 108/43; 108/23; 108/25; 312/330.1; 248/444

[58] Field of Search ..... 108/43, 45, 23, 108/25; 248/444; 312/330.1; 11/348.4

[56] References Cited

U.S. PATENT DOCUMENTS

| | | | |
|---|---|---|---|
| 1,613,440 | 1/1927 | Carek . | |
| 3,512,487 | 5/1970 | Kranz et al. | 108/23 |
| 4,537,646 | 8/1985 | Hoyle . | |
| 4,564,091 | 1/1986 | Coneglio . | |
| 4,595,086 | 6/1986 | Simpson . | |
| 4,654,762 | 3/1987 | Laverick | 108/23 X |
| 4,700,634 | 10/1987 | Mills et al. . | |
| 4,751,620 | 6/1988 | Wright et al. | 108/23 X |
| 4,765,583 | 8/1988 | Tenner . | |
| 4,892,334 | 1/1990 | Sinclair . | |
| 4,957,235 | 9/1990 | Beno et al. | 108/25 X |
| 5,114,110 | 5/1992 | Vohora | 248/444 |
| 5,388,530 | 2/1995 | Jacobus | 108/43 |
| 5,460,102 | 10/1995 | Pasmanick . | |
| 5,549,375 | 8/1996 | Pagliaccio | 312/330.1 X |
| 5,680,973 | 10/1997 | Vulpitta et al. | 108/43 X |

FOREIGN PATENT DOCUMENTS

| | | | |
|---|---|---|---|
| 561253 | 8/1933 | Germany | 108/23 |
| 176651 | 4/1935 | Switzerland | 108/23 |

*Primary Examiner*—Peter M. Cuomo
*Assistant Examiner*—Hanh V. Tran
*Attorney, Agent, or Firm*—Robert L. Shaver; Frank J. Dykas

[57] ABSTRACT

A portable writing desk which includes a light which can be positioned below the writing surface for illuminating tracing materials or can be positioned above the writing surface for illuminating reading, writing or drawing activities. A portable desk has a removable drawer with a writing surface on the removable drawer. A portable desk also includes a removable board, which has a third writing surface. A cushion is attached which allows for comfortable placement of the writing desk on a person's lap while in a seated position.

21 Claims, 8 Drawing Sheets

PORTABLE THREE-WAY DESK

BACKGROUND OF THE INVENTION

1. Field of the Invention

The present invention generally relates to portable desks, and more particularly to portable lap-type desks which have a built-in tracing light and a tracing surface.

2. Background Information

There are many occasions when a person needs a portable surface to use as a desk for reading and writing. In response to this need, there are a number of such portable desks which sit on a person's laptop and provide a hard surface for reading and writing. Some of these portable desks have a built-in light, storage compartments for materials, and some have a cushion for placing the desks on a person's lap when they are in a seated position.

There are several particular situations in which a portable desk is commonly needed, and for which no suitable desk is available. One of these situations is when several children are riding in a car, or traveling on a train or airplane, and when a surface for reading, writing and tracing would help entertain a number of children. At present, this situation can be met by the use of clipboards or their equivalent, or a number of portable desk units, one for each child. Even with the use of such clipboards and portable desk units, there is no provision for tracing, a common and entertaining activity for children and adults.

Another situation is when the need to trace arises. Adults, as well as children, often find the need to trace. For instance, when a person traces a pattern for embroidery or paper piecing, floor plans for a house, outlines for a sketch, or any number of situations when tracing is useful. There is no portable writing surface which provides a tracing option.

Another situation when a need exists is when families with children travel on airplanes, and an activity center could be brought on board as carry-on luggage.

What is needed then is a portable writing desk which can provide multiple working surfaces for more than one user. The ideal such portable writing desk would provide at least three working surfaces, so that three children or adults could have a working surface for reading, writing, drawing and tracing, all at the same time.

Accordingly, it is an object of the invention to provide a portable desk which provides multiple works surfaces, so that several users can read, write, draw or trace on a work surface. Another object of the invention is to provide a work surface for tracing which is illuminated from beneath, and which is provided with a clamping device for holding paper, both the traced paper and the tracing paper, in place on the work surface.

Another object of the invention is to provide a multiple work surface portable desk which sits comfortably on a person's lap by the use of a removable cushion.

A further object of the invention is to provide a portable work station with an illuminated work surface. A further object of the invention is to provide a portable work station with an internal drawer for storage of materials, and which also serves as a work surface.

Another object of the invention is to provide a portable writing desk with a removable cover, in which the cover serves as a supplemental cushion, a carrying handle, a storage unit and a protective cover for the desk.

Additional objects, advantages and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

According to the present invention, the foregoing and other objects and advantages are attained by a portable writing desk for tracing, reading and writing. This portable writing desk includes a generally rectangular housing which has a work surface on its top surface. The work surface serves as a first writing and tracing surface. The housing provides storage space for a tracing and reading light, and the batteries which power it. The tracing and reading light can be placed in a tracing position so that the underside of a work is illuminated through a non-opaque material on the first work surface. The light can also be positioned for illuminating material on the work surface from above, for reading and writing. The light is stored in the housing in a storage position.

This portable writing desk can include a detachable cushion, which attaches to the bottom side of the housing and allows the portable writing desk to be comfortably positioned on a user's lap. The portable writing desk can also include a storage compartment for reading, writing and tracing materials. The material of the first work surface is of a non-opaque material, and this can be a transparent or translucent material which may or may not have grid lines marked on the surface to facilitate tracings of certain projects. The portable desk can also include one or more clamps for holding a traced sheet of paper in place, and for holding the tracing paper in position above the traced paper. The portable writing desk can include a cover which attaches around the portable writing desk and serves as a supplemental cushion, handle and carrying case.

The portable writing desk can also include a removable drawer, which provides storage for writing, reading and tracing materials, and which has a second work surface on its top side. This removable drawer can have a tilt-down front face, which allows access to reading and writing materials without removing the drawer from the housing. The drawer can have a bottom piece which adjusts to put the work surface of the drawer at an angle for comfortable writing and reading. The portable writing desk can also include a removable third work surface, which is a generally rectangular and planar piece which attaches to the underside of the housing and to which the cushion is attached. This third work surface piece is a rigid board which is reversible, can be removed from the portable writing desk and used separately by another person for reading, writing and drawing. The third work surface piece could be a reversible magnetic board. The cushion can attach to the third work surface, the removable drawer, or the housing. The cushion can have elastic straps and a deep pocket to hold a book, and has Velcro place holder or book mark.

The portable writing desk also includes a cover which is of a flexible material and is used to wrap around the assembled portable writing desk. It can have pockets inside and out for storage of materials. It has shoulder straps so that the portable writing desk with cover can be carried like a backpack or purse. The cover also has a handle which allows the portable writing desk to be carried like a briefcase. The cover can also be positioned with the straps across the user's back and the desk positioned in the user's front in a usable position. The cover can also serve as a supplemental cushion, by folding or rolling the cover, and placing it under one of the work surfaces to achieve the desired angle of the work surface, or to act as a cushion on the user's lap.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawing and description are to be regarded as illustrative in nature, and not as restrictive.

DESCRIPTION OF THE PREFERRED EMBODIMENTS

Figure 1:
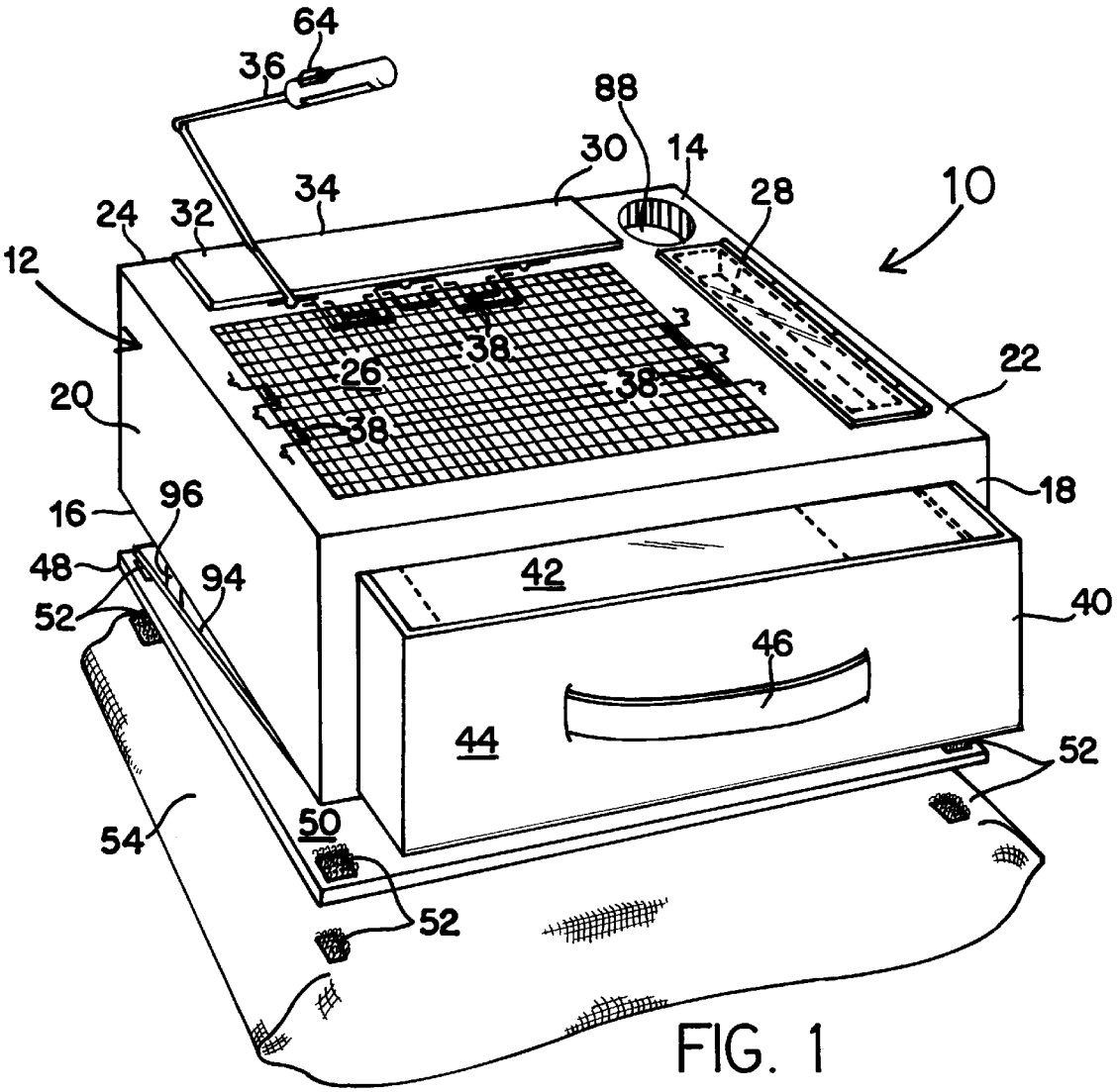
FIG. 1 is a perspective partially exploded view of a portable writing desk.
Figure 2:
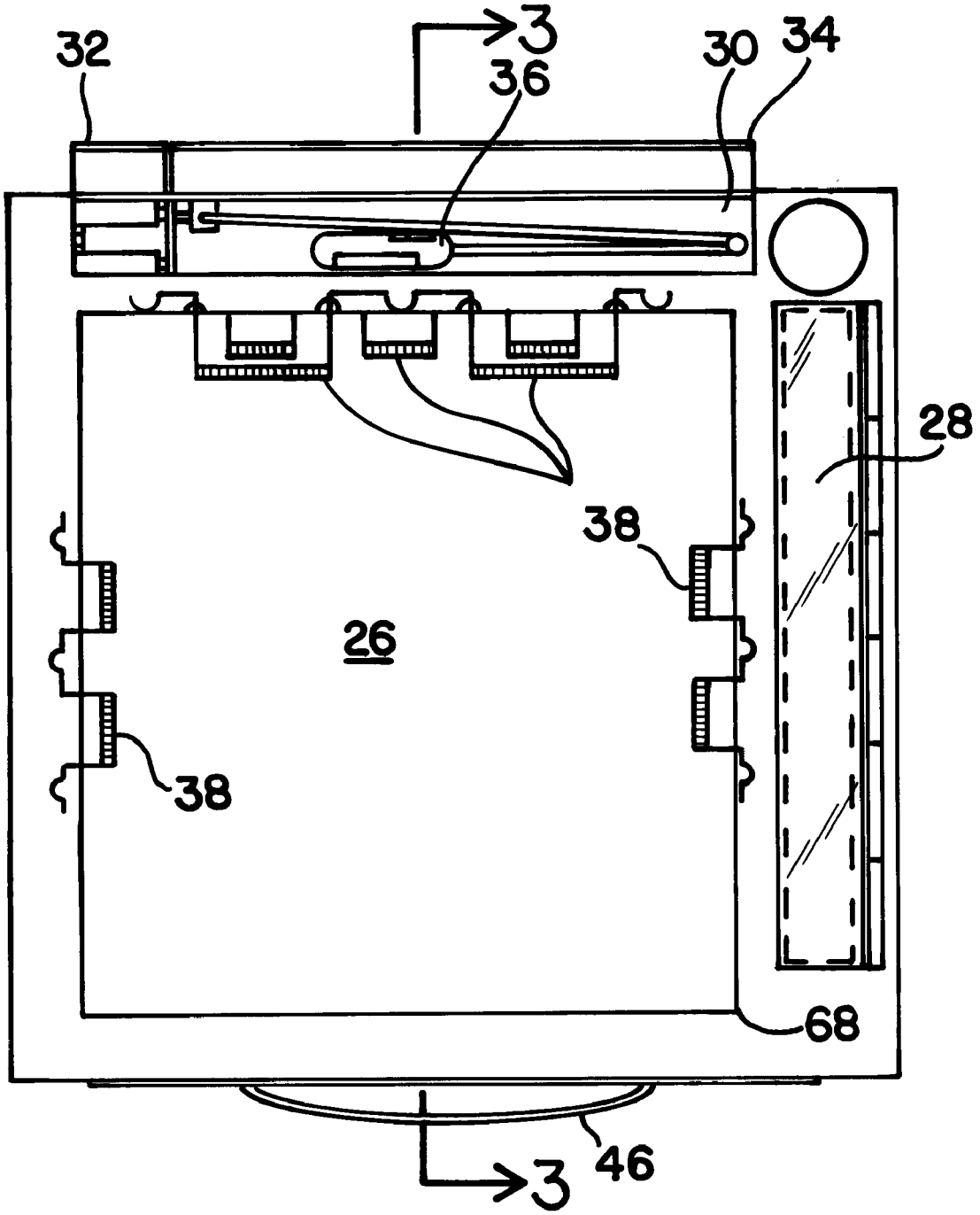
FIG. 2 is a top view of the portable writing desk.
Figure 3:
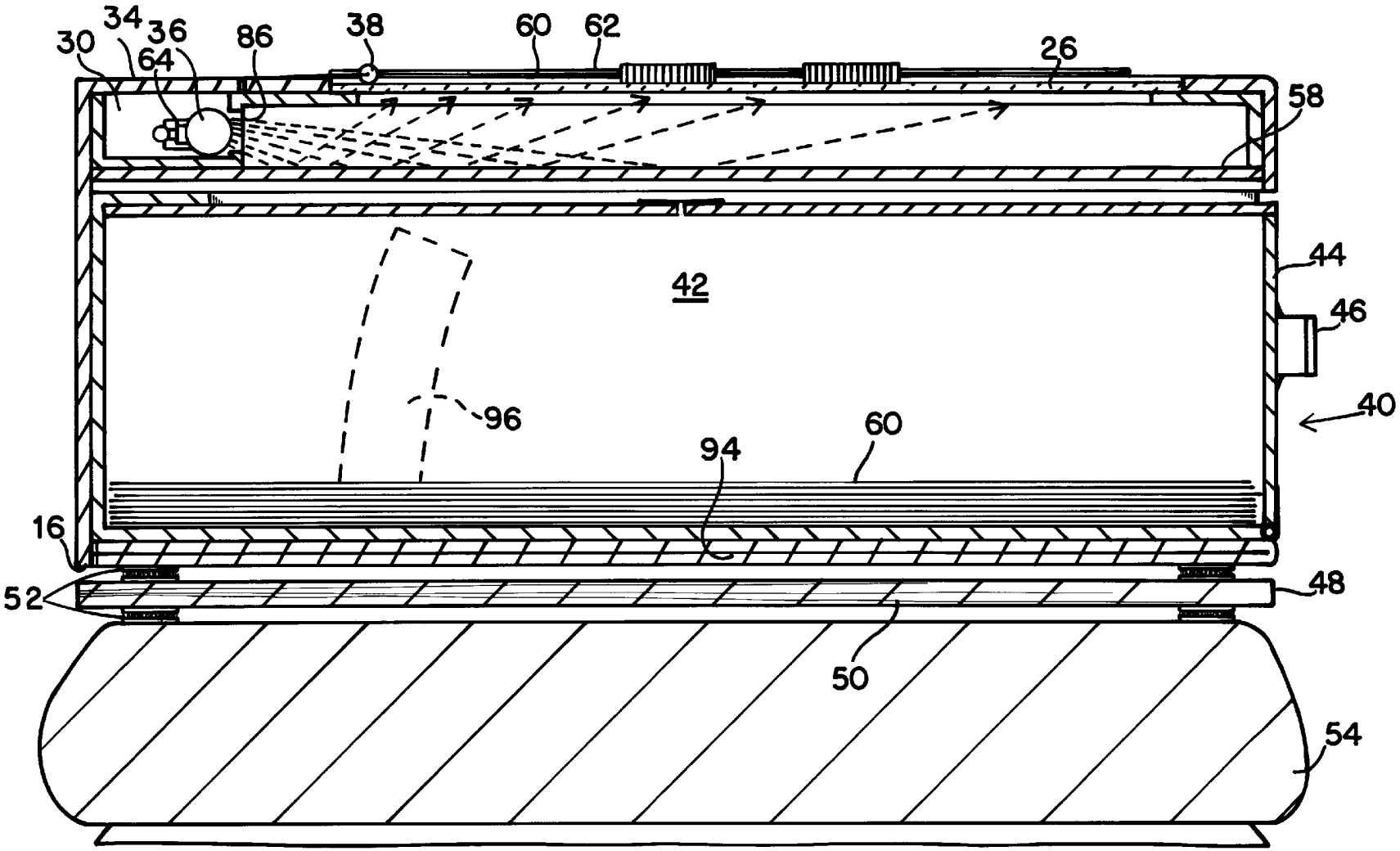
FIG. 3 is a cross-sectional side view of a portable writing desk showing the light configured for tracing.

The preferred embodiment of the invention is shown in the figures. FIG. 1 is a perspective view of the device. Referring to FIG. 1, portable desk 10 is shown. Portable desk 10 can be made of a number of materials, such as molded plastic, cardboard, paper or wood. At present it is preferred that the portable desk be made of a molded plastic, but other materials with suitable characteristics can be utilized. Portable desk 10 includes a housing 12, which is a generally rectangular unit, with a top side 14, a bottom side 16, a drawer side 18, a left side 20, a right side 22, and a light side 24. On the top side 14 of the housing 12 is located a first working surface 26. This first working surface 26 is a non-opaque material, and is preferably a transparent or translucent plastic. A second working surface 62, which is preferably a plastic sheet, may have grid lines or other tracing aids inscribed on it. The portable desk 10 may come with a number of interchangeable first working surfaces 26 with different tracing aids inscribed on each of them. First working surface 26 is removable from the housing 12. The housing 12 also contains a storage compartment 28 for storing pens and pencils, and may contain a recessed cylindrical region 88 for holding a drinking cup or small items such as paper clips. The housing 12 also includes a light storage compartment 30. The light storage compartment 30 includes a first flap 32 and a second flap 34, which can be closed when a light is extended from storage compartment 30. A light 36 is mounted inside the light storage compartment 30, and extends over the first working surface 26 when in a working position. The light 36 can also be mounted in a tracing position, as shown in FIG. 3, which also serves as a storage position. It can also be extended to a position under the center of first working surface 26. The light 36 can also be removed from housing 12, and be mounted on removable drawer 40, third working surface 50, or cushion 54, to provide light for reading, writing or tracing.

Figure 4A:
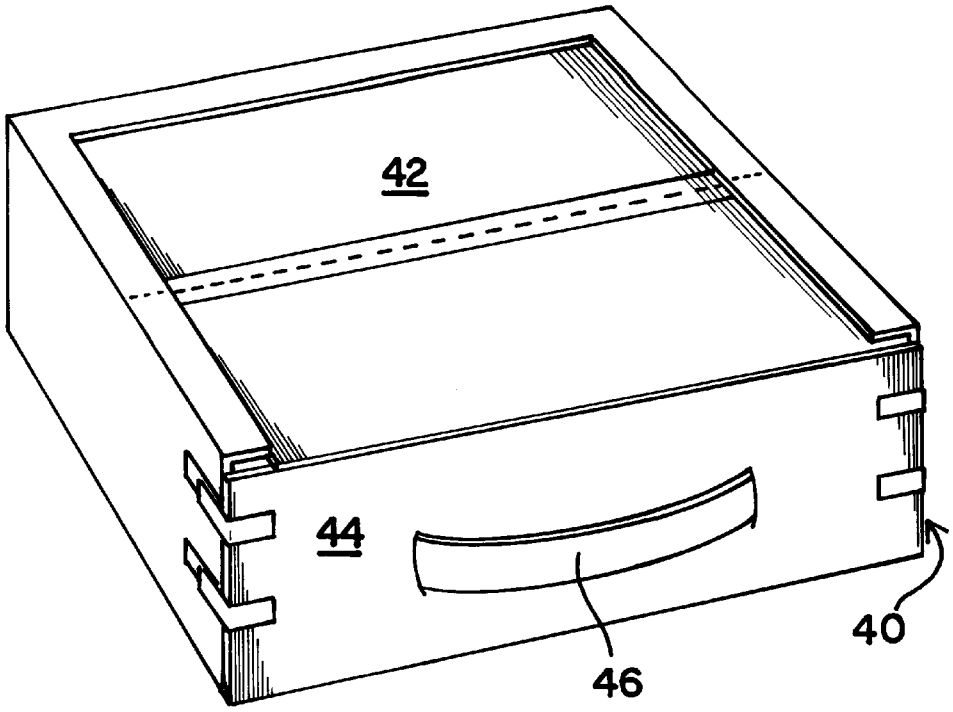
FIG. 4A is a perspective view of the removable drawer for the portable writing desk.
Figure 4B:
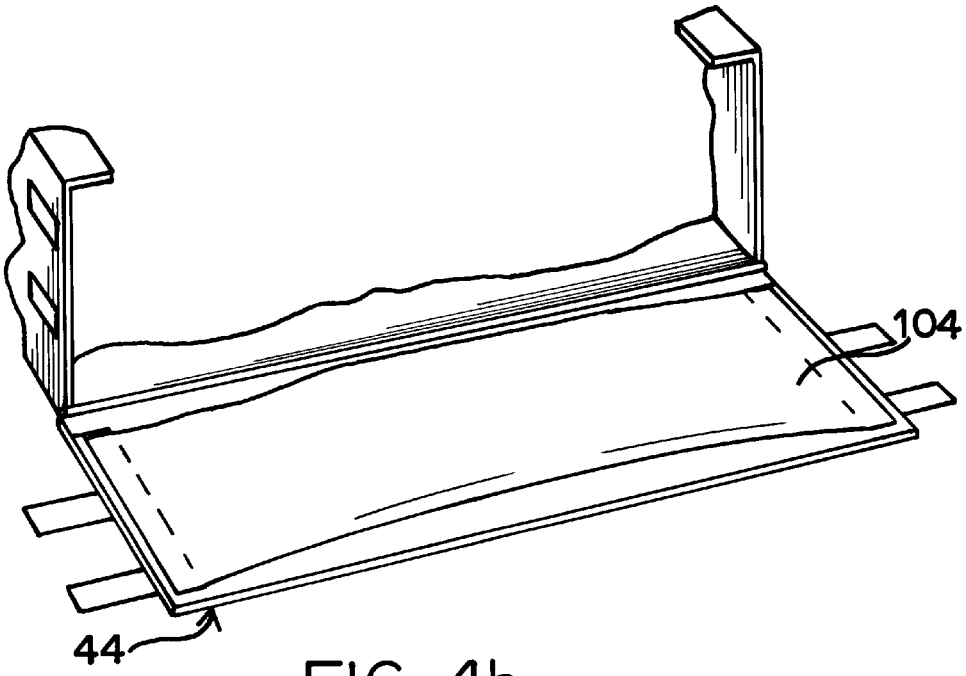
FIG. 4B is a perspective view of the removable drawer with its lid lowered, and a storage compartment visible.

Housing 12 also includes one or more clamps 38, which hold the paper to be traced in place and secure the tracing paper above the paper to be traced. On the bottom of housing 12 is a riser 96, as shown in FIG. 1, and an adjustment base 94. These can be used to incline the first working surface 26 toward the user. Portable desk 10 also includes a removable drawer 40, shown in FIG. 1 and FIGS. 4A and 4B. The removable drawer 40 includes a second working surface 42, a drop down drawer front 44, a drawer pull 46, and a storage pocket 104.

A portable desk 10 also includes a removable and reversible board 48, which includes a third working surface 50. The removable board 48 and the third working surface 50 are preferably a white board, which is a white laminate over a magnetic surface with a composite core with a reverse smooth surface for writing. This provides a rigid working surface which a person can use on their lap as a surface for drawing, writing or reading. The removable board 48 attaches to the bottom of the housing 12 by the use of hook and loop fasteners 52.

Figure 7:
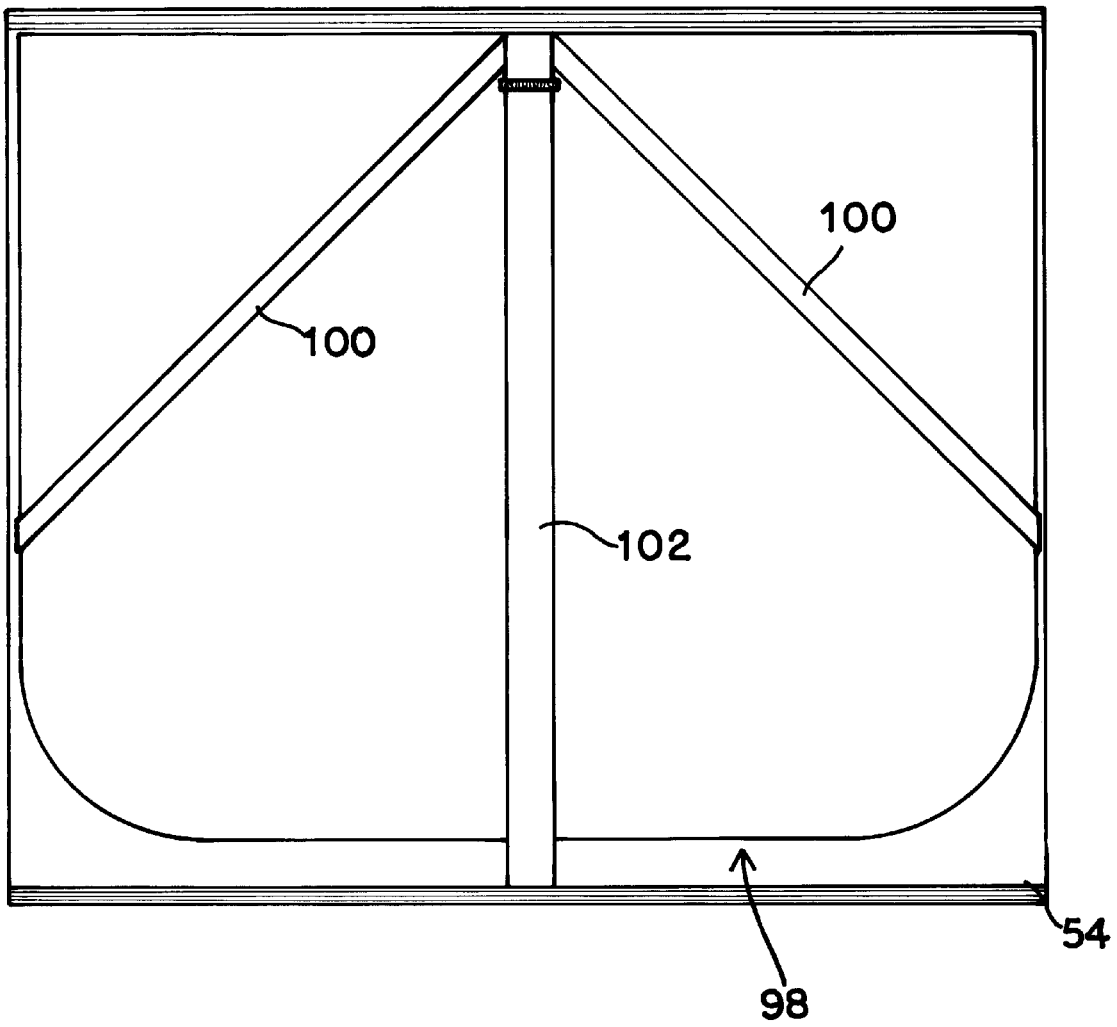
FIG. 7 is a top view of a cushion showing a storage pocket, elastic straps, and bookmark.

A portable desk 10 also includes a cushion 54. The cushion is preferably filled with a yielding but firm material, such as buckwheat hulls. However, many other materials could be suitable, such as Styrofoam® beads, open or closed cell foam, plastic beads, foam particles, or any number of alternate materials. It can have a deep pocket, elastic straps and a bookmark, as shown in FIG. 7. The cushion 54 also has a book pocket 98, for storing a book or other object. A book (not shown) is placed with its corners under elastic straps 100, thereby holding said book open, and book mark 102 is used to mark the place.

Figure 6A:
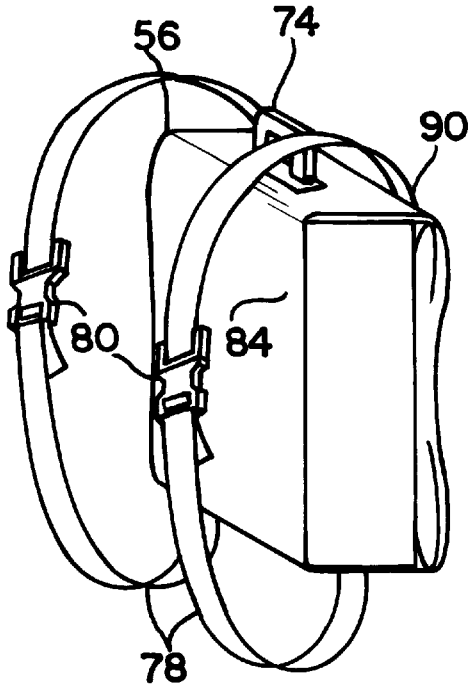
FIG. 6A is a perspective view of the portable writing desk with the cover installed to form straps for carrying like a backpack.
Figure 6B:
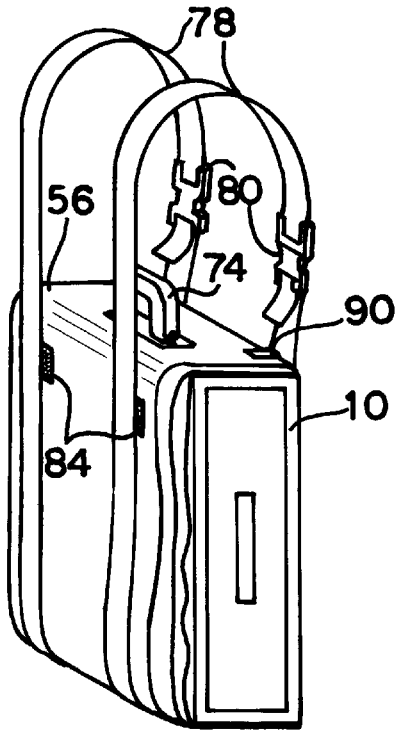
FIG. 6B is a perspective view of the portable writing desk with the cover installed to form straps for carrying like a bag.
Figure 6C:
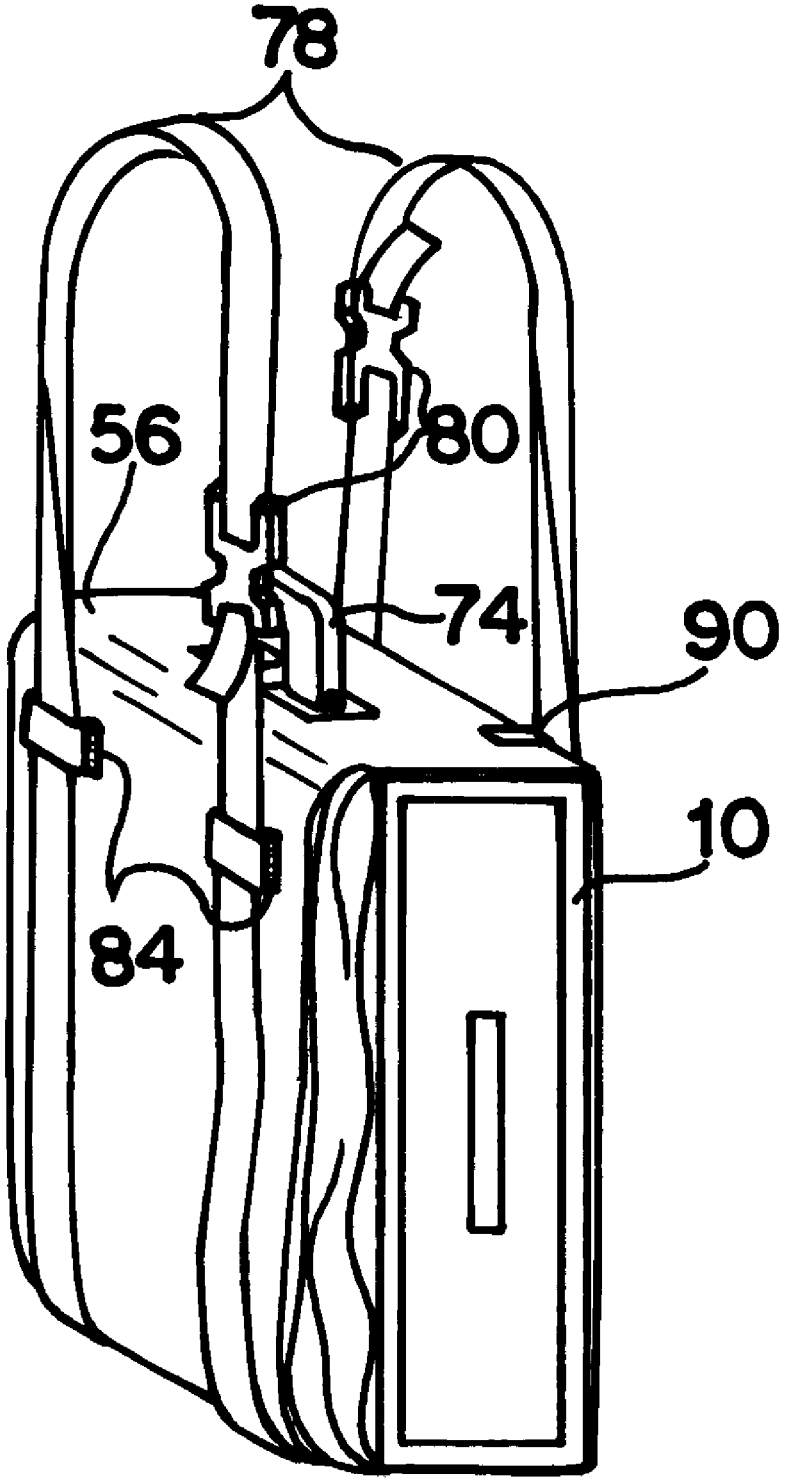
FIG. 6C is a perspective view of the portable writing desk with the cover installed to form straps for carrying like a purse.

Cover 56 includes a rectangular panel 72. On one edge of rectangular panel 72 is a handle 74. On the edge opposite the handle 74 is a handle slot 76. On edges of the rectangular panel 72 opposite from the handle and handle slot are attached two carrying straps 78. Each carrying strap 78 includes an adjusting buckle 80 for adjusting the length of the carrying strap. The carrying straps can operate as shown in FIG. 6A, as a backpack, as shown in FIG. 6B, with carrying loops, or with the straps arranged like a purse as in FIG. 6C. The rectangular panel 72 attaches to the portable writing desk by Velcro® tabs 82, which attach to corresponding Velcro® tabs (not shown) on the portable desk 10. Attached to the rectangular panel 72 are strap buckles (not shown), through which one end of the carrying straps 78 pass and are secured. The cover 56 is preferably made of a heavy canvas or nylon material, but other suitable materials would also work, such as cotton, leather, or plastic. The cover 56 is mounted on the portable desk 10 by placing portable desk 10 on the rectangular panel 72. Then the Velcro® tabs 82 on the cover engage corresponding Velcro® tabs (not shown) on the portable desk 10. The handle 74 is lifted over the top of portable desk 10 and the handle slot 76 is also lifted across the portable desk 10, causing the cover 56 to encircle the portable desk 10. The handle 74 is extended through the handle slot 76, and Velcro® tabs 90 on the cover engage corresponding Velcro® tabs 92 on the cover to further secure the cover 56 on the portable desk 10. While the cover 56 is on the portable desk 10, it serves as a carrying handle and protective cover. When removed from the portable desk 10, the cover 56 can be rolled up or folded into a pad, and placed below the portable desk 10 or below one of the writing surfaces of the portable desk 10. In this way it serves as a supplemental or alternative cushion for one of the writing surfaces. The cover 56 can have pockets mounted on it for storage of items.

Figure 5:
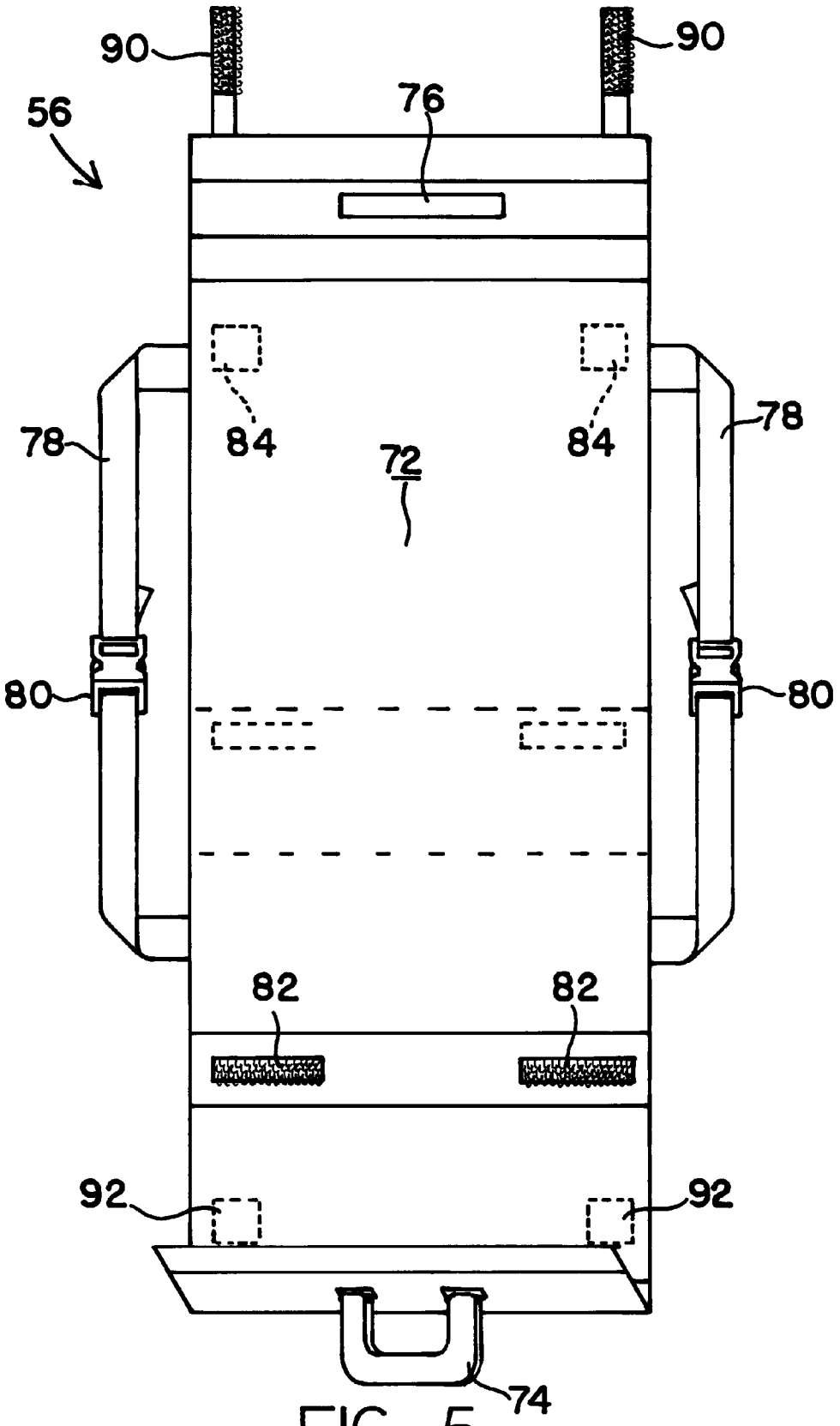
FIG. 5 is a top plan view of the cover for the portable writing desk.

To use the portable desk 10, the cover 56, shown in FIG. 5, is first removed. If the portable desk 10 is to be used as a tracing device, it would be configured as shown in FIG. 3. The light 36 would be inside the light storage compartment 30, with the light 36 directed to shine through a window 86 in the storage compartment 30 onto a reflecting surface 58, or to extend to a position in the center and directly under first work surface 26. Light from the reflecting surface 58 would shine through the first working surface 26, which is a transparent or translucent sheet of plastic with or without grid lines. A piece of paper 60 would be mounted over the first working surface 26, as shown in FIG. 3. In the preferred embodiment, a second plastic sheet 62 would be clamped over the piece of paper 60 and holds the traced paper 60 in place. A second sheet of paper is placed on top of the second plastic sheet 62, and serves as the tracing paper. The light is switched on using switch 64 and the paper or pattern to be traced and the tracing paper are illuminated from below.

If multiple users are to use the various work surfaces of the portable desk 10, or if work in different stages is to be viewed, then the removable board 48 can be removed from the housing 12, and the cushion 54 can be attached to either the removable board 48, the drawer 40, or the housing 12. The light mounted in housing 12 can be attached to drawer 40, removable board 48, or cushion 54. The first working surface 26 of the housing 12 can be used by one person for reading, writing, drawing or tracing. The third working surface 50 of the removable board 48 can be used by another person for reading, writing or drawing, and the removable drawer 40 can be removed from the housing 12 and the second working surface 42 can be used by another person for reading, writing or drawing.

In this way the light 36 can be used for tracing or to illuminate a first working surface 26. The portable desk 10 can also provide writing, drawing and reading surfaces for as many as three users at the same time. The portable desk 10 also provides for storage of tracing and drawing materials and the removable drawer 40 provides storage room for paper, or for a lap top computer, calculator, palm-held computer, marking pens, tape, stapler, fabric, sewing needs, notebooks or other tracing, reading, sewing, writing or drawing tools.

While there is shown and described the present preferred embodiment of the invention, it is to be distinctly understood that this invention is not limited thereto but may be variously embodied to practice within the scope of the following claims.

We claim:

1. A portable writing desk for tracing, reading, and writing, which comprises:

a generally rectangular housing, in which a non-opaque first work surface of said housing serves as a first writing and tracing surface and in which said housing provides storage space for a tracing and reading/writing light;

a light, which can be placed in a tracing position for illuminating an underside of said work surface for tracing, or for illuminating material on said work surface for reading and writing, and which is stored in said housing in a storage position; and a cushion, which removably attaches to said housing and when positioned on a user's lap provides a stable and comfortable base for said portable writing desk, said cushion further comprising straps for holding a book open, a strap-like bookmark, and a book storing pocket.

2. The portable writing desk of claim 1 in which said housing further comprises a storage compartment for reading, writing, sewing and tracing materials.

3. The portable writing desk of claim 1 in which said non-opaque first work surface of said housing further comprises a transparent material.

4. The portable writing desk of claim 1 which further comprises one or more paper clamps for holding a sheet of paper on said first work surface, to facilitate tracing and drawing.

5. The portable writing desk of claim 1 which further comprises a cover which serves as a supplemental cushion, handle, and carrying case.

6. The portable writing desk of claim 1 which further comprises a removable drawer with storage for reading, writing, and tracing material, and which has a second work surface.

7. The portable writing desk of claim 6 in which said removable drawer further comprises a tilt-down front face, which allows access to reading and writing materials.

8. The portable writing desk of claim 1 which further comprises a removable third work surface, which is a generally rectangular and planar piece which attaches to an underside of said housing, which can be removed for use as a writing surface, and to which is attached said cushion having elastic straps.

9. A portable writing desk for tracing, reading, and writing, which comprises:

a generally rectangular housing, in which a transparent first work surface of said housing serves as a first writing and tracing surface and in which said housing provides storage space for a tracing and reading/writing light, and reading, writing and tracing materials;

a light, which can be placed in a tracing position for illuminating an underside of said work surface for tracing, or for illuminating material on said work surface for reading and writing, and which is stored in said housing in a storage position;

a removable drawer with storage for reading, writing, and tracing material, and which has a second work surface;

one or more paper clamps for holding a sheet of paper on said first work surface, to facilitate tracing and drawing;

a removable third work surface, which is a generally rectangular and planar piece which attaches to an underside of said housing, which can be removed for use as a writing surface; and a cushion, which removably attaches to said removable third work surface and when positioned on a user's lap provides a stable and comfortable base for said portable writing desk.

10. The portable writing desk of claim 9 which further comprises a cover which serves as a supplemental cushion, handle, and carrying case.

11. The portable writing desk of claim 9 in which said removable drawer further comprises a tilt-down front face, which allows access to reading and writing materials.

12. A portable writing desk for tracing, reading, and writing, which comprises:

a generally rectangular housing, in which a non-opaque first work surface of said housing serves as a first writing and tracing surface and in which said housing provides storage space for a tracing and reading/writing light;

a light, which can be placed in a tracing position for illuminating an underside of said work surface for tracing, or for illuminating material on said work surface for reading and writing, and which is stored in said housing in a storage position; and a removable third work surface, which is a generally rectangular and planar piece which attaches to an underside of said housing, which can be removed for use as a writing surface.

13. The portable writing desk of claim 12 in which said housing further comprises a storage compartment for reading, writing, sewing and tracing materials.

14. The portable writing desk of claim 12 in which said non-opaque first work surface of said housing further comprises a transparent material.

15. The portable writing desk of claim 12 which further comprises one or more paper clamps for holding a sheet of paper on said first work surface, to facilitate tracing and drawing.

16. The portable writing desk of claim 12 which further comprises a cover which serves as a supplemental cushion, handle, and carrying case.

17. The portable writing desk of claim 12 in which said first working surface of said housing further comprises a transparent material with grid lines marked on a surface of said transparent material.

18. The portable writing desk of claim 12 which further comprises a removable drawer with storage for reading, writing, and tracing material, and which has a second work surface.

19. The portable writing desk of claim 18 in which said removable drawer further comprises a tilt-down front face, which allows access to reading and writing materials.

20. The portable writing desk of claim 12 which further comprises a cushion.

21. The portable writing desk of claim 20 wherein said cushion, which removably attaches to said removable third work surface, when positioned on a user's lap provides a stable and comfortable base for said portable writing desk.

* * * * *